US010718470B1

(12) United States Patent
Wu

(10) Patent No.: US 10,718,470 B1
(45) Date of Patent: Jul. 21, 2020

(54) RETRO LED LIGHT BULB

(71) Applicant: Jinjiang Wonderful Photoelectric Lighting Co., Ltd., Fujian (CN)

(72) Inventor: Linlin Wu, Fujian (CN)

( * ) Notice: Subject to any disclaimer, the term of this patent is extended or adjusted under 35 U.S.C. 154(b) by 0 days.

(21) Appl. No.: 16/526,996

(22) Filed: Jul. 30, 2019

(30) Foreign Application Priority Data

Apr. 22, 2019 (CN) ..... 2019 2 0547323 U

(51) Int. Cl.

| | |
|---|---|
| ***F21K 9/232*** | (2016.01) |
| ***F21K 9/235*** | (2016.01) |
| ***F21K 9/237*** | (2016.01) |
| ***F21K 9/66*** | (2016.01) |
| ***F21V 23/02*** | (2006.01) |
| ***F21V 23/00*** | (2015.01) |
| ***F21K 9/238*** | (2016.01) |
| *F21Y 115/10* | (2016.01) |

(52) U.S. Cl.

CPC ..... *F21K 9/232* (2016.08); *F21K 9/235* (2016.08); *F21K 9/237* (2016.08); *F21K 9/238* (2016.08); *F21K 9/66* (2016.08); *F21V 23/002* (2013.01); *F21V 23/02* (2013.01); *F21Y 2115/10* (2016.08)

(58) Field of Classification Search
None
See application file for complete search history.

(56) References Cited

U.S. PATENT DOCUMENTS

2017/0012177 A1* 1/2017 Trottier ..... H01L 25/0753

* cited by examiner

*Primary Examiner* — Sean P Gramling
(74) *Attorney, Agent, or Firm* — Prakash Nama; Global IP Services, PLLC

(57) ABSTRACT

The present invention provides a retro LED light bulb comprising a transparent lampshade and a base fixedly connected with the transparent lampshade. It further comprises a transparent stem inside the transparent lampshade, a power supply board fixedly mounted on the transparent stem, rigid conductive wires passing through the transparent stem and connecting to the power supply board, and an LED filament fixedly connected to the rigid conductive wires; the rigid conductive wires are two in number; the LED filament is in U-shape; two ends of the LED filament are respectively connected to the rigid conductive wires as one-to-one connection. Since the LED filament is supported by the rigid conductive wires, and the LED filament is bent into a U-shape, the light emitted by the LED filament will not be blocked by the stem easily, resulting in more uniform light and better illumination effect.

6 Claims, 5 Drawing Sheets

RETRO LED LIGHT BULB

BACKGROUND OF THE INVENTION

The present invention relates to a light bulb and more particularly pertains to a retro LED light bulb.

Conventional light bulbs are usually tungsten light bulbs using tungsten wires as light-emitting components; they are relatively high in power consumption, relatively low in brightness and high in heat emission. Therefore, tungsten light bulbs are gradually replaced by LED light bulbs. However, the majority of LED light bulbs usually use a translucent but not transparent lampshade, which is quite different from conventional light bulbs in terms of outer appearance. Although some LED light bulbs use transparent lampshades, their LED filaments are usually linearly or spirally mounted on the stems. Part of the light from the LED filaments is blocked by the stems, resulting in partial reflection or refraction which causes uneven illumination and affects illumination effect.

Besides, lampshades and stems of existing light bulbs are usually made of glass which is vulnerable. Glass lampshades and stems also need to be heated and sintered by an open fire during the manufacturing process. This induces certain safety risks.

In view of the above, the Applicant has conducted in-depth research on the structure of LED light bulbs, thereby devising the present invention.

BRIEF SUMMARY OF THE INVENTION

It is an object of the present invention to provide a retro LED light bulb with a better illumination effect.

To attain this, the present invention adopts the following technical solution:

A retro LED light bulb comprises a transparent lampshade and a base fixedly connected with the transparent lampshade. It further comprises a transparent stem inside the transparent lampshade, a power supply board fixedly mounted on the transparent stem, rigid conductive wires passing through the transparent stem and connecting to the power supply board, and an LED filament fixedly connected to the rigid conductive wires. The rigid conductive wires are two in number. The LED filament is in U-shape. Two ends of the LED filament are respectively connected to the rigid conductive wires as one-to-one connection.

As an improvement of the present invention, the transparent lampshade and the transparent stem are made of plastic.

As an improvement of the present invention, one end of the transparent stem which is distant from the base is provided with a positioning groove. The rigid conductive wires each comprises a filament connection section, a positioning section and a power connection section which are connected in sequence. The positioning sections are inserted in the positioning groove. A distance between the filament connection sections of the two rigid conductive wires is greater than a distance between the power connection sections of the two rigid conductive wires.

As an improvement of the present invention, the power supply board is provided with positioning holes. The transparent stem is provided with positioning protrusions which match with the positioning holes.

As an improvement of the present invention, a cavity is provided at one end of the transparent stem where the positioning groove is not provided. The power supply board is located in the cavity.

As an improvement of the present invention, the transparent lampshade comprises an assembly portion inserted inside the base. A sealant is encapsulated between an outer sidewall of the assembly portion and an inner sidewall of the base.

As an improvement of the present invention, the base is a threaded base. An external threaded segment that matches with the threaded base is provided on the assembly portion.

As an improvement of the present invention, the transparent stem is provided with a cavity.

With the above technical solution, the present invention has the following beneficial effects:

1. Since the LED filament is supported by the rigid conductive wires, and the LED filament is bent into a U-shape, the light emitted by the LED filament will not be blocked by the stem easily, resulting in more uniform light and better illumination effect.

2. Since the transparent lampshade and the transparent stem are made of plastic, they are not vulnerable and can be formed by injection molding or blow molding during processing without using an open fire, and hence enhancing production safety.

3. By encapsulating the sealant, the waterproof performance of the light bulb is effectively improved.

4. By providing an external threaded segment on the assembly portion, the connection stability between the lampshade and the base can be improved.

Figure 1:
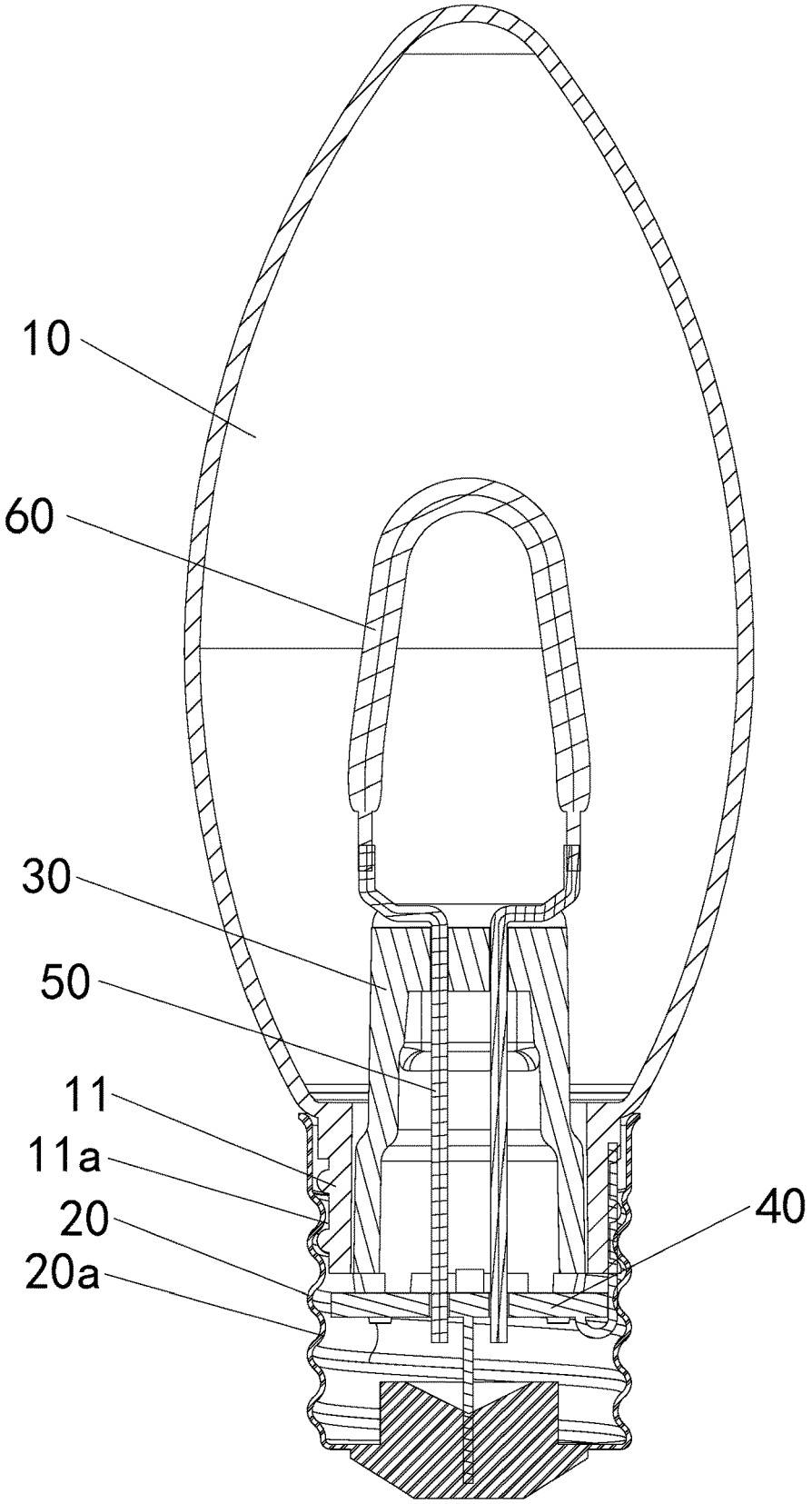
FIG. 1 shows a cross-sectional view of a retro LED light bulb of Embodiment 1, wherein the PC transparent material is not shown.
Figure 2:
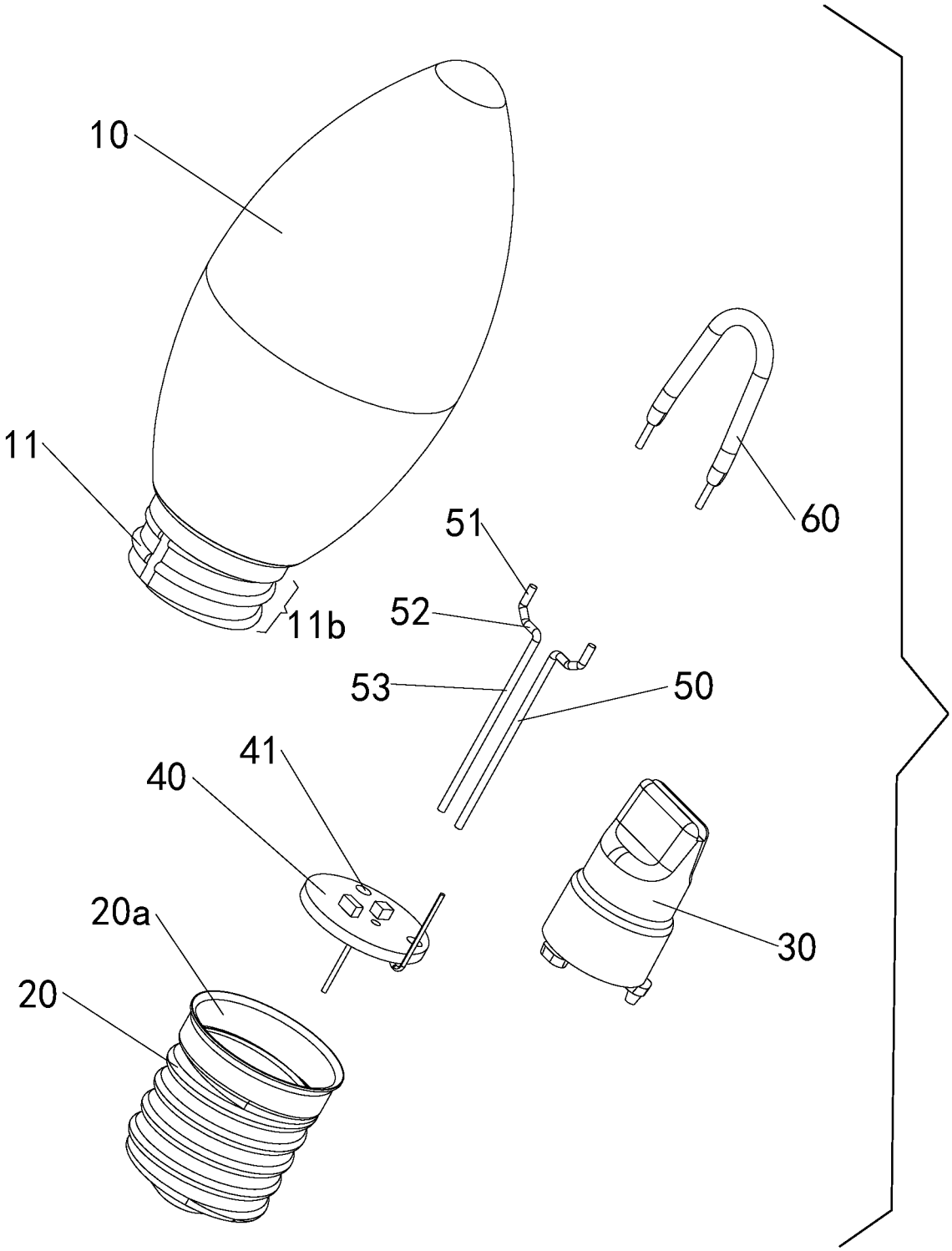
FIG. 2 shows an exploded view of the retro LED light bulb of Embodiment 1.
Figure 3:
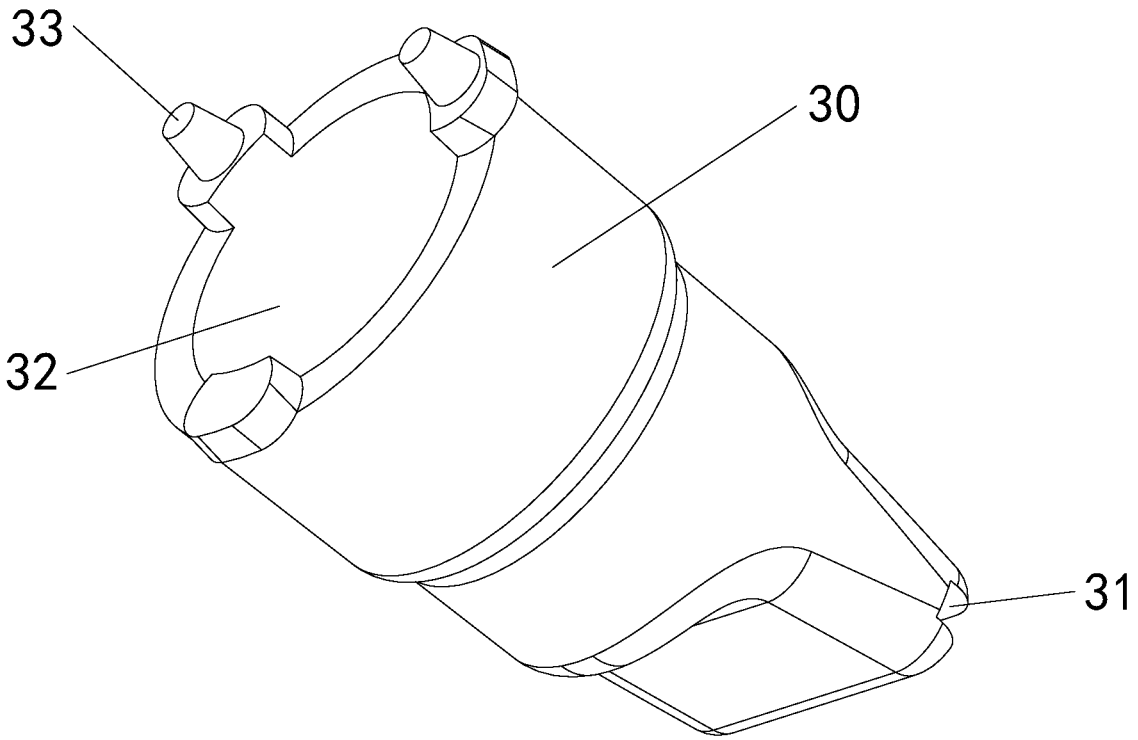
FIG. 3 shows a schematic view of the structure of the transparent stem of Embodiment 1.
Figure 4:
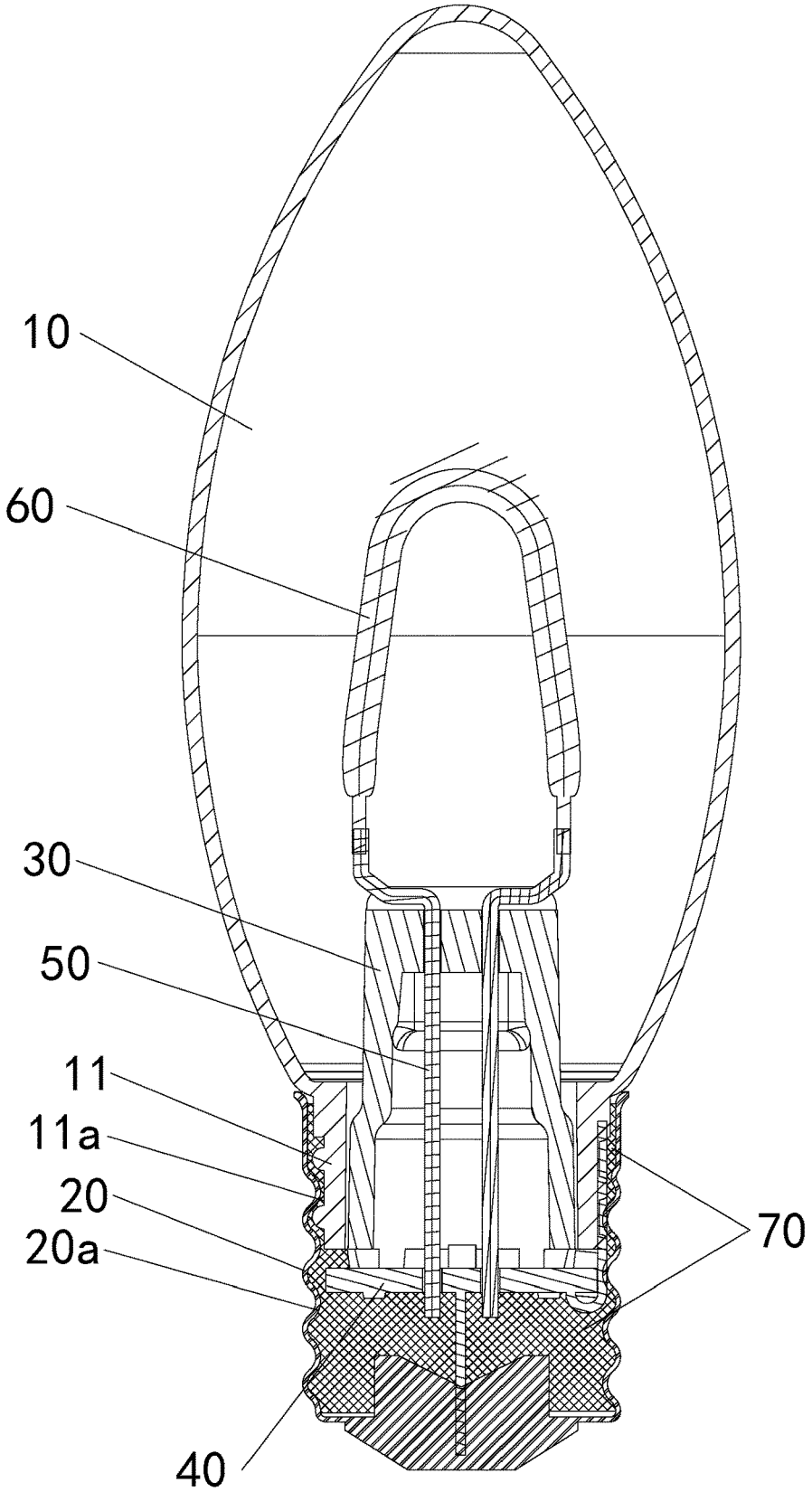
FIG. 4 shows a cross-sectional view of the retro LED light bulb of Embodiment 1 with the PC transparent material.

The references in the figure correspond to the following: 10—transparent lampshade; 11—assembly portion; 11*a*—outer sidewall of the assembly portion; 11*b*—external threaded segment; 20—base; 20*a*: inner sidewall of the base; 30—transparent stem; 31—positioning groove; 32—cavity; 33—positioning protrusion; 40—power supply board; 41—positioning hole; 50—rigid conductive wire; 51—filament connection section; 52—positioning section; 53—power connection section; 60—LED filament; 70—sealant.

DETAILED DESCRIPTION OF THE INVENTION

The present invention will be further described below in conjunction with the accompanying drawings and specific embodiments.

Embodiment 1

As illustrated in FIGS. 1, 2, 3 and 4, the retro LED light bulb of the present embodiment comprises a transparent lampshade 10, a base 20 fixedly connected to the lampshade 10, a transparent stem 30 inside the transparent lampshade 10, a power supply board 40 fixedly mounted on the transparent stem 30, rigid conductive wires 50 passing through the transparent stem 30 and connecting to the power supply board 40, and an LED filament 60 fixedly connected to the rigid conductive wires 50. The transparent lampshade 10 and the transparent stem 30 are made of plastic, thereby improving the anti-drop capability of the light bulb and avoiding the use of open fire in the manufacturing process (plastic parts can be blow-molded or injection-molded).

The transparent lampshade 10 comprises an assembly portion 11 inserted inside the base 20. The portion of the transparent lampshade 10 which is not inserted inside the base 20 has an outer appearance which is identical to the lampshade of a conventional tungsten light bulb, and the specific shape can be designed according to actual needs. The base 20 is a threaded base used in conventional tungsten filament light bulbs. Its main body is usually pressure formed by a metal sleeve. Therefore, when an external thread of the threaded opening of the base 20 is formed, an internal threaded bore is naturally formed in the interior of the base 20. An external threaded segment 11*b* that matches with the internal threaded bore of the threaded base is provided on the assembly portion 11. A sealant 70 is encapsulated between an outer sidewall 11*a* of the assembly portion 11 and an inner sidewall 20*a* of the base 20. In this way, the connection is more secured so that the transparent lampshade 10 and the base 20 are not easily disconnected due to external force when the light bulb is installed, and the waterproof performance of the light bulb is effectively improved.

One end of the transparent stem 30 which is distant from the base 20 is provided with a positioning groove 31. The positioning groove 31 is linearly arranged and parallel to the radial direction of the base 20. The positioning groove 31 has a groove bottom which is provided with through holes for the rigid conductive wires 50 to pass through. The transparent stem 30 is provided with a cavity 32. The cavity 32 connects with the exterior at one end of the transparent stem 30 where the positioning groove 31 is not provided; it provides certain heat dissipation, and the positioning groove 31 connects with the cavity 32 via the through holes. In addition, the outer diameter of the end of the transparent stem 30 where the positioning groove 31 is not provided matches the diameter of the mouth of the lampshade 10; preferably, the two are clearance fitted to each other to achieve a fixed connection between the two via the sealant.

The power supply board 40 may be a power supply board used in a conventional LED light bulb. Preferably, the power supply board 40 of the present embodiment is provided with positioning holes 41 on the basis of a conventional power supply board, and the transparent stem 30 is provided with positioning protrusions 33 which match with the positioning holes to enable connection between the transparent stem 30 and the power supply board 40. Of course, if necessary, the positioning protrusions 33 can also be provided with snap structure.

The rigid conductive wires 50 each comprises a filament connection section 51, a positioning section 52 and a power connection section 53 which are connected in sequence. The positioning sections 52 are inserted in the positioning groove 31. The power connection sections 53 pass through the cavity 32. The filament connection sections 51 are located at the end of the transparent stem 30 which is distant from the base 20 and do not contact the transparent stem 30. Of course, there are two rigid conductive wires 50; the power connection sections 53 of the two rigid conductive wires 50 are respectively connected to the positive output interface and the negative output interface on the power supply board 40, and the distance between the filament connection sections 51 of the two rigid conductive wires 50 is greater than the distance between the power connection sections 53 of the two rigid conductive wires 50.

The LED filament 60 is in U-shape with the mouth of the U-shape facing towards the transparent stem 30. Two ends of the LED filament 60 are respectively connected to the two rigid conductive wires 50 as one-to-one connection to ensure that the light beams emitted from the LED filament 60 are not blocked by the transparent stem 30, and thus the illumination is relatively even.

The present embodiment further provides a manufacturing method of the aforementioned retro LED light bulb. The manufacturing method comprises the following steps:

S1: Injection blowing of the lampshade: PC transparent plastic material is heated by an industrial injection blowing machine to a temperature of about 270° C. and then injected into a lampshade mold for high-speed pressurized injection blowing to obtain the transparent lampshade 10.

S2: SMT processing: Apply solder paste or red adhesive on the electronic component mounting position of the power supply board solder pad (including the PCB board), and then adhere the electronic components to their corresponding positions on the power supply board by an automatic mounting machine. The electronic components are then soldered to the power supply board solder pad by reflow soldering to form a semi-finished power supply board. The electronic components and the power supply board solder pad are conventional components whose structures are the same as those of conventional LED light bulbs and are therefore not detailed herein.

S3: Plug-in components processing: Feed the semi-finished power supply board adhered with the electronic components to a plug-in components assembly line; insert two lead wires according to the positions marked by L and N on the PCB board of the semi-finished power supply board, and then put it into a wave soldering furnace for wetting to obtain a power supply board 40.

S4: Semi-finished product inspection: First, visually check whether the surface of the PCB board is clean, whether there is any absent electronic component, and whether wetting of the power supply board solder pad is proper; then put the semi-finished power supply board into a testing fixture for testing.

S5: LED filament soldering: Place the two formed rigid conductive wires 50 and the LED filament 60 in the fixture; use a high frequency DC spot soldering machine to securely solder the rigid conductive wires 50 and the LED filament 60. The LED filament 60 may be obtained by bending a linear LED filament or using a U-shaped LED filament directly.

S6: Assembling the plastic stem: Bend the LED filament 60 to a U-shape, and insert the two rigid conductive wires 50 through the holes on the transparent stem 30, and then put them into a spinning plastic disc.

S7: Soldering the power supply board: Insert the two rigid conductive wires 50 through the corresponding output interfaces of the power supply board 40 according to their polarity, then place them in the fixture, and use a soldering iron to solder to the power supply board solder pad firmly.

S8: Power-on test: With a power supply of AC120V 60 HZ, perform lighting test using a test probe.

S9: Assembling the lampshade: Align the transparent stem 30 with the transparent lampshade 10 and assemble the two; remove the rubber cover of the wire on the N-electrode of the power supply board 40, and bend the exposed copper wire from one side of the transparent lampshade 10 to abut against the threaded surface of the transparent lampshade 10; the transparent lampshade 10 is then placed in the fixture with its tip pointed downward.

S10: Copper soldering of solder joint of the threaded opening: Put the base 20 with its threaded opening facing downward on the wire of the L-electrode of the power supply board 40; use an electric iron to wet the solder joint with tin; the solder joint is required to have an arc shape, a smooth surface and without burrs.

S11: Encapsulating glue: Bend the connecting wire of the threaded opening of the base 20 which is soldered with the solder joint, and position it to an automatic glue dispenser with the threaded opening facing upward. When the outlet of the automatic glue dispenser is aligned with the threaded opening, press the machine switch to apply a standard amount of glue (i.e. sealant 70) to the threaded opening. The standard amount is the same as that of a conventional LED light bulb and therefore will not be detailed herein.

S12: Fastening the threaded opening: Fasten the threaded opening of the base 20 with glue applied thereon to the lampshade according to the screw thread direction and place them to the fixture, and wait for the glue to solidify to obtain a retro LED light bulb.

S13: Testing the finished product: Visually inspect the appearance of the retro LED light bulb with solidified glue; check for leakage, whether the threaded opening is in place, and whether there is any residue inside the lampshade; then perform testing with a power supply of AC120V 60 HZ.

Embodiment 2

Figure 5:
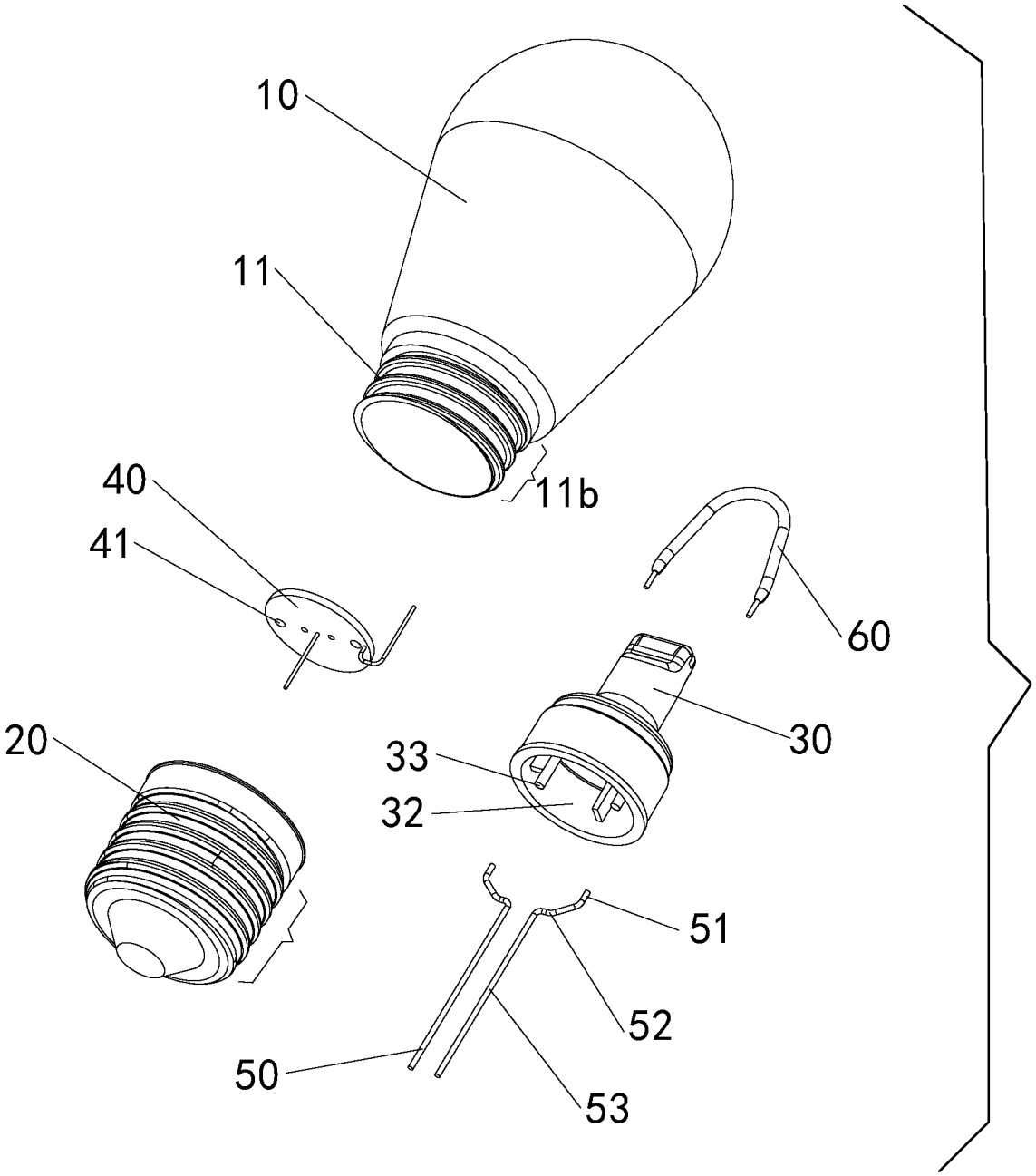
FIG. 5 shows an exploded view of a retro LED light bulb of Embodiment 2.

As illustrated in FIG. 5, the differences between the present embodiment and Embodiment 1 are that the transparent lampshades 10 are different and the positional relationships between the transparent stems 30 and the power supply boards 40 are different. Specifically, one end of the transparent stem 30 which is not provided with the positioning groove 31 is provided with a cavity 32. The cavity 32 is also connected to the exterior at the end of the transparent stem 30 which is not provided with the positioning groove 31; it provides certain heat dissipation, and the positioning groove 31 connects with the cavity 32 via the through holes. However, in the present embodiment, the power supply board 40 is located in the cavity 32. In order to ensure the fit between the positioning protrusions 33 and the positioning holes 41, the positioning protrusions 33 are located in the cavity 32. Preferably, the cavity 32 is also provided with a limiting board to fit with the power supply board 40.

The present invention is described in detail above in conjunction with the accompanying drawings, but the present invention is capable of other embodiments and is not limited by the above embodiments. Any variations based on the prior art performed by a person skilled in the art falls within the scope of protection of the present invention.

What is claimed is:

1. A retro LED light bulb comprising a transparent lampshade and a base fixedly connected with the transparent lampshade, characterized in that it further comprises a transparent stem inside the transparent lampshade, a power supply board fixedly mounted on the transparent stem, rigid conductive wires passing through the transparent stem and connecting to the power supply board, and an LED filament fixedly connected to the rigid conductive wires; the rigid conductive wires are two in number; the LED filament is in U-shape; two ends of the LED filament are respectively connected to the rigid conductive wires as one-to-one connection; one end of the transparent stem which is distant from the base is provided with a positioning groove; the rigid conductive wires each comprises a filament connection section, a positioning section and a power connection section which are connected in sequence; the positioning sections are inserted in the positioning groove; a distance between the filament connection sections of the two rigid conductive wires is greater than a distance between the power connection sections of the two rigid conductive wires; the power supply board is provided with positioning holes; the transparent stem is provided with positioning protrusions which match with the positioning holes.

2. The retro LED light bulb as in claim 1, wherein the transparent lampshade and the transparent stem are made of plastic.

3. The retro LED light bulb as in claim 1, wherein a cavity is provided at one end of the transparent stem where the positioning groove is not provided; the power supply board is located in the cavity.

4. The retro LED light bulb as in claim 1, wherein the transparent lampshade comprises an assembly portion inserted inside the base; a sealant is encapsulated between an outer sidewall of the assembly portion and an inner sidewall of the base.

5. The retro LED light bulb as in claim 4, wherein the base is a threaded base; an external threaded segment that matches with the threaded base is provided on the assembly portion.

6. The retro LED light bulb as in claim 1, wherein the transparent stem is provided with a cavity.

* * * * *